US006665896B1

(12) United States Patent
Tseng

(10) Patent No.: US 6,665,896 B1
(45) Date of Patent: Dec. 23, 2003

(54) HAMMOCK ASSEMBLY WITH FOLDABLE LEFT AND RIGHT FRAMES

(75) Inventor: Chuen-Jong Tseng, Chiayi Hsien (TW)

(73) Assignee: Shin Yeh Enterprise Co., Ltd., Chiayi Hsien (TW)

( * ) Notice: Subject to any disclaimer, the term of this patent is extended or adjusted under 35 U.S.C. 154(b) by 0 days.

(21) Appl. No.: 10/237,378

(22) Filed: Sep. 9, 2002

(51) Int. Cl.[7] ..... A47K 11/02
(52) U.S. Cl. ..... 5/121; 5/120; 5/128; 5/129
(58) Field of Search ..... 5/120, 121, 127, 5/128, 129

(56) References Cited

U.S. PATENT DOCUMENTS 3,593,352 A * 7/1971 Britt ..... 5/127
3,783,458 A * 1/1974 Westrich ..... 5/129
5,392,476 A * 2/1995 Williams ..... 5/127
5,983,422 A * 11/1999 Bayless ..... 5/120

* cited by examiner

*Primary Examiner*—Anthony Knight
*Assistant Examiner*—Fredrick Conley
(74) *Attorney, Agent, or Firm*—Ladas & Parry

(57) ABSTRACT

A hammock assembly includes a left frame and a right frame opposite to and pivoted to the left frame such that the left and right frames are rotatable relative to each other between an unfolded position, in which, mounting ends of the left and right frames are moved away from each other, and a folded position, in which, the mounting ends of said left and right frames move toward each other. A bedding sheet is disposed above the left and right frames, and has two opposite ends respectively connected to the mounting ends of the left and right frames such that the bedding sheet will be stretched when the left and right frames are disposed at the unfolded position and that the bedding sheet will be folded when the left and right frames are disposed at the folded position.

3 Claims, 6 Drawing Sheets

HAMMOCK ASSEMBLY WITH FOLDABLE LEFT AND RIGHT FRAMES

FIELD OF THE INVENTION

The invention relates to a hammock assembly, more particularly to a hammock assembly with foldable left and right frames so as to facilitate transport and storage thereof.

BACKGROUND OF THE INVENTION

Referring to FIG. 1, a first conventional hammock assembly 1 is shown to include a support frame 11 having two transverse bases 112 and a longitudinally extending U-shaped sheet-support 111 fixed on the transverse bases 112, and a bedding sheet 12 that is disposed above the support frame 11 and that has two opposing ends 122 fastened to top ends 113 of the sheet-support 111 via two sets of ropes 123 and rings 124.

One disadvantage of the first conventional hammock assembly resides in that, although the bedding sheet 12 can be detached from the support frame 11, the support frame 11 is difficult to transport and occupies a relatively large amount of storage space. Moreover, the support frame 11 cannot be detached into minor parts, and is hardly appreciated and liked by users.

Referring to FIG. 2, a second conventional hammock assembly 2 is shown to include a base support 21 and a bedding sheet 22. The base support 21 includes two transverse parts 211, two curved support rods 212 fastened on the transverse parts 211, and two pairs of suspension rods 213,214 extending respectively and detachably from opposite ends of the curved support rods 212. The bedding sheet 22 is disposed above the base support 21, and has two opposite ends respectively and detachably fastened to the suspension rods 213, 214 of the base support 21 via two sets of ropes 221 and hooks 215.

Although the base support 21 of the aforesaid conventional hammock assembly 2 can be detached into minor parts so as to facilitate transport and storage, detachment of the base support 21 is both time-consuming and inconvenient.

SUMMARY OF THE INVENTION

Therefore, the object of this invention is to provide a hammock assembly which includes pivotally connected left and right frames so as to eliminate the aforesaid disadvantages that are generally associated with the conventional hammock assemblies.

Accordingly, the hammock assembly of this invention includes: a left frame having a mounting end; a right frame having a mounting end and opposite to and pivoted to the left frame about a pivot such that the left and right frames are rotatable relative to each other between an unfolded position, in which, the mounting ends of the left and right frames are moved away from each other, and a folded position, in which, the mounting ends of the left and right frames are moved toward each other; and a bedding sheet disposed above the left and right frames, and having two opposite ends respectively connected to the mounting ends of the left and right frames such that the bedding sheet will be stretched when the left and right frames are disposed at the unfolded position and that the bedding sheet will be folded when the left and right frames are disposed at the folded position.

BRIEF DESCRIPTION OF THE DRAWINGS

Other features and advantages of this invention will become more apparent in the following detailed description of the preferred embodiment of this invention, with reference to the accompanying drawings, in which.

DETAILED DESCRIPTION OF THE PREFERRED EMBODIMENT

Figure 1:
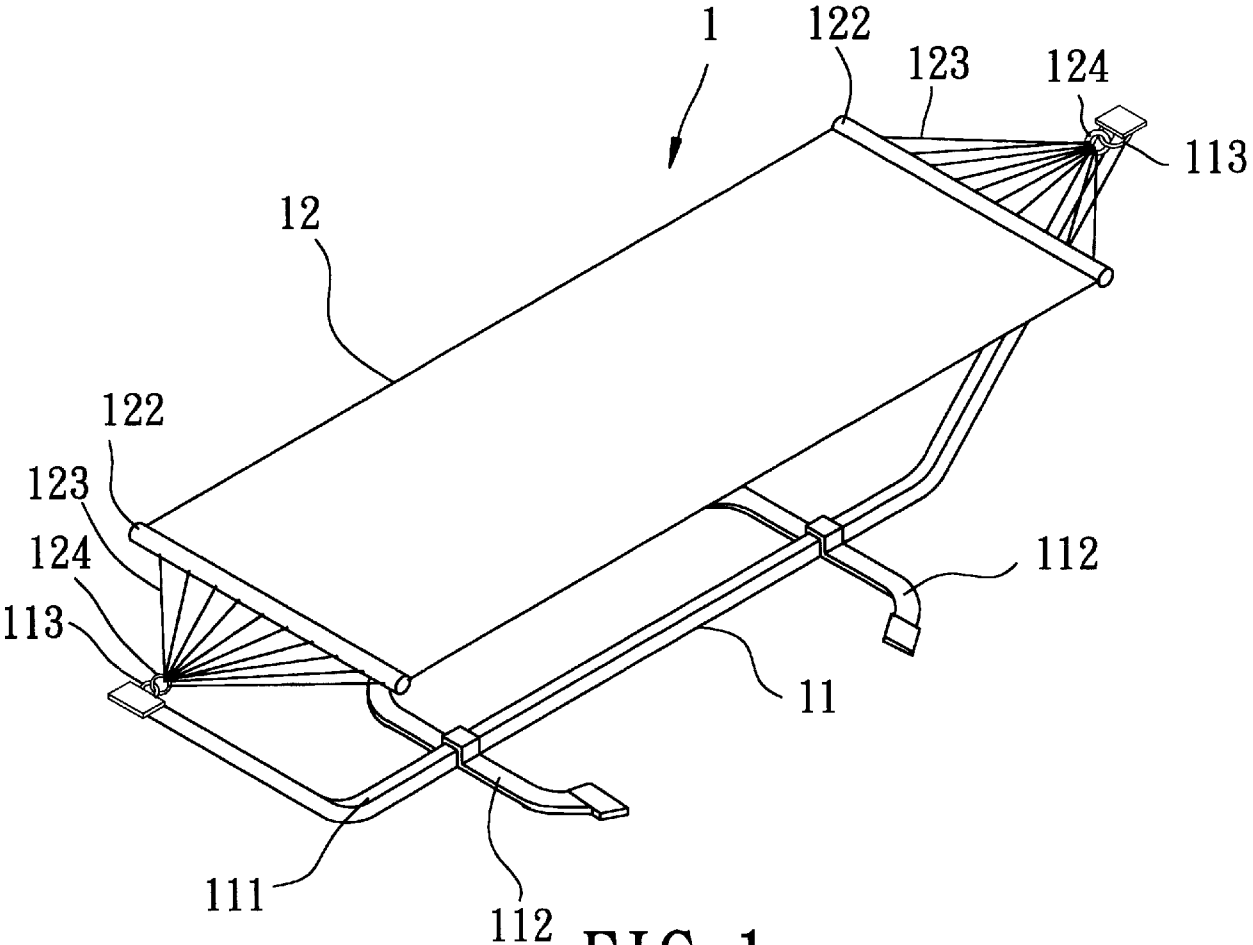
FIG. 1 PRIOR ART
FIG. 1 is a perspective view of a first conventional hammock assembly.
Figure 2:
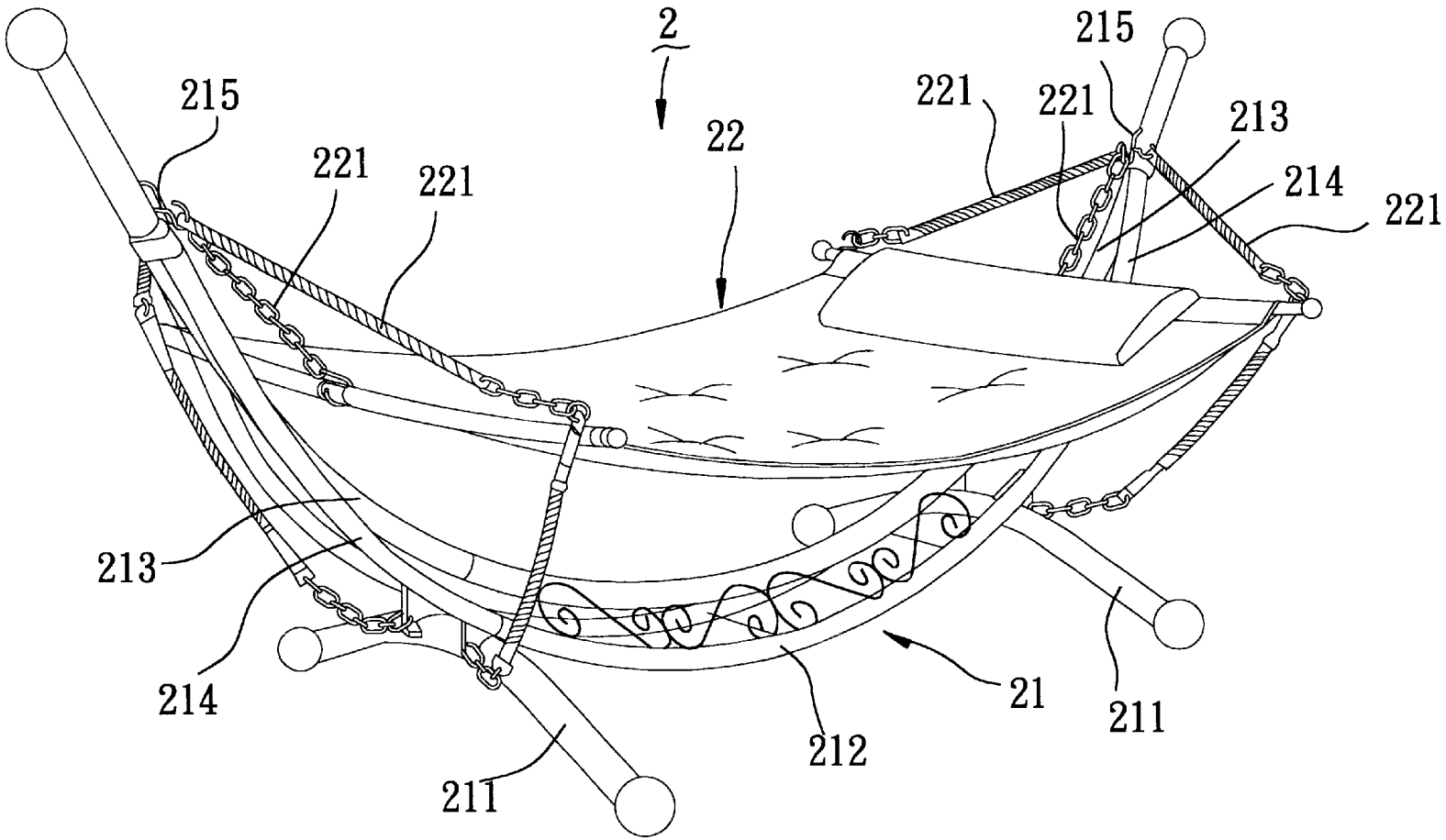
FIG. 2 PRIOR ART
FIG. 2 is a perspective view of a second conventional hammock assembly.
Figure 3:
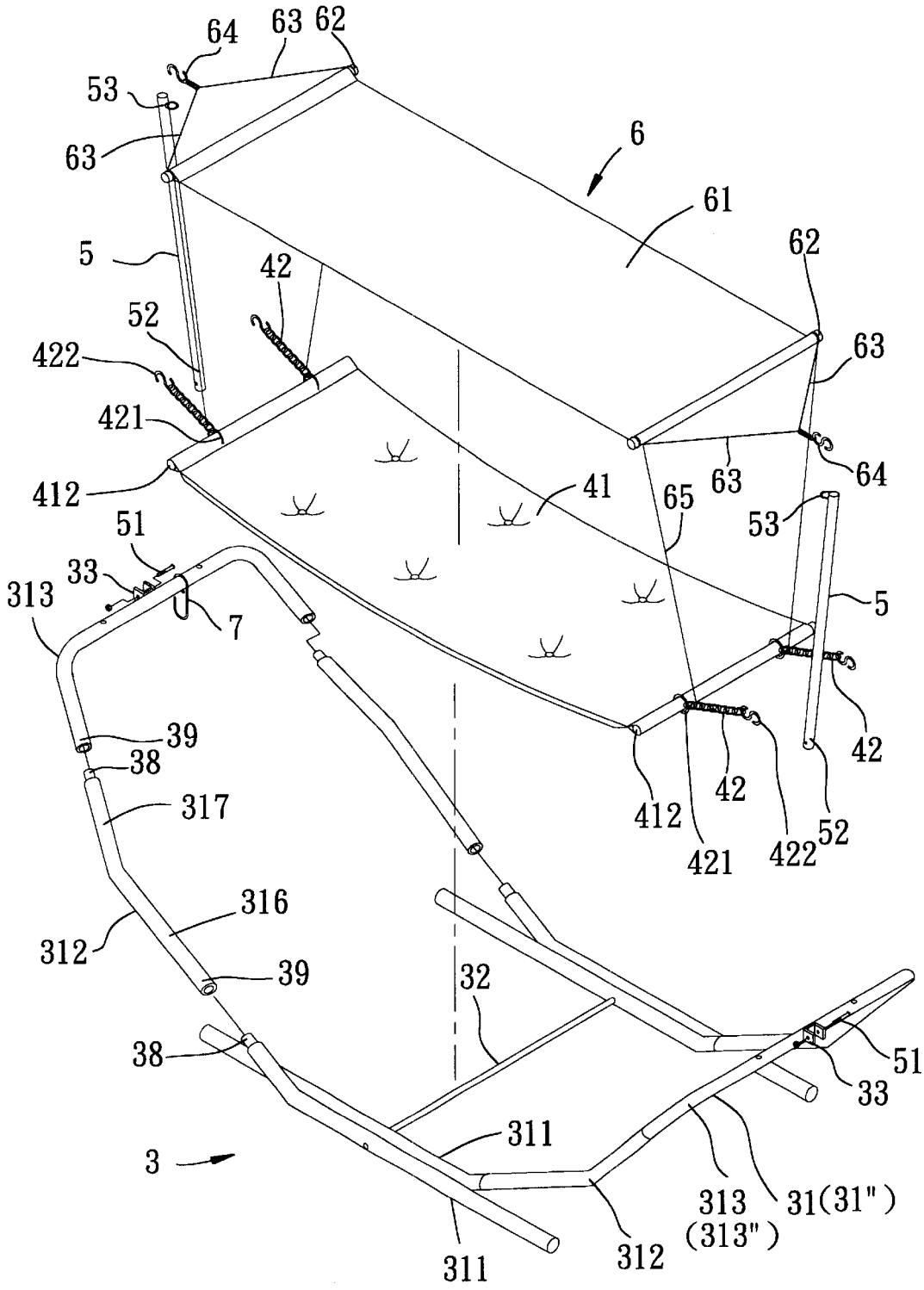
FIG. 3 is an exploded view of the preferred embodiment of a hammock assembly according to the present invention.
Figure 4:
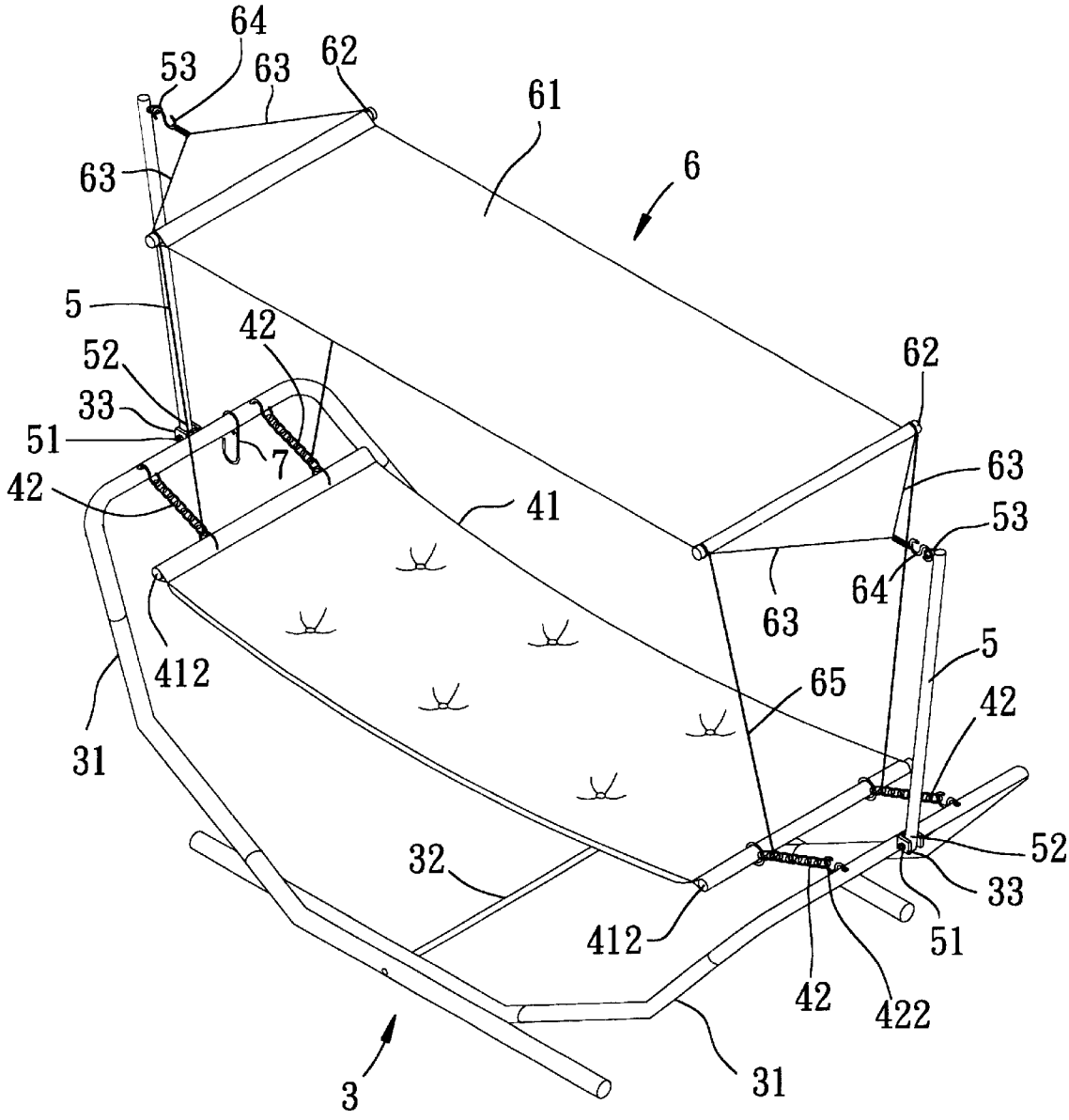
FIG. 4 is a perspective view of the preferred embodiment, illustrated in an unfolded state.
Figure 5:
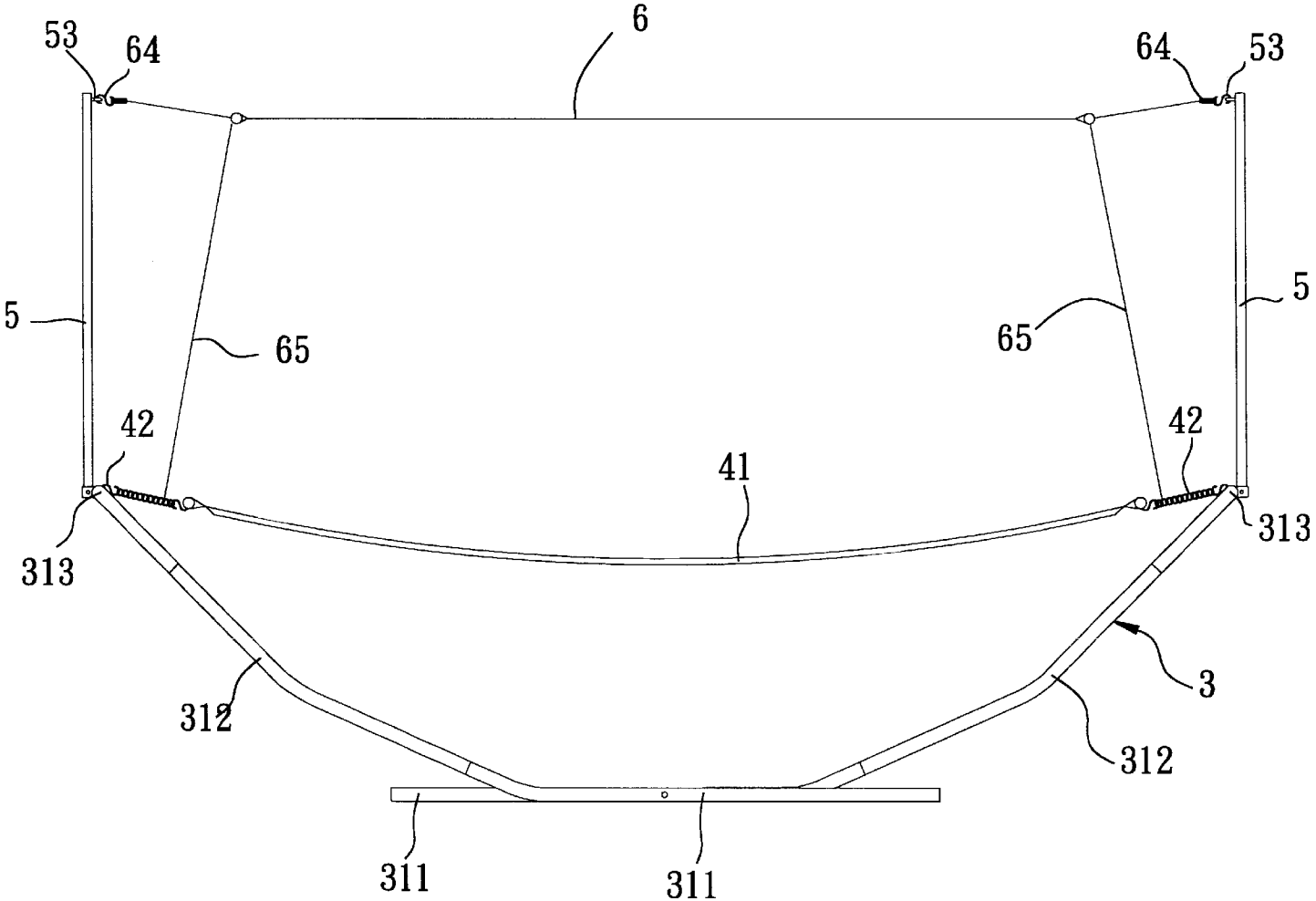
FIG. 5 is a side view of the preferred embodiment, illustrated in the unfolded state.

Referring to FIGS. 3 to 5, the preferred embodiment of a hammock assembly according to this invention is shown to include a left frame 31, a right frame 31, and a bedding sheet 41.

As illustrated, the left frame 31 has a mounting end 31".

The right frame 31 has,a mounting end 31", and is disposed opposite to and is pivoted to the left frame 31 about a pivot such that the left and right frames 31 are rotatable relative to each other between an unfolded position (see FIG. 5), in which, the mounting ends 31" of the left and right frames 31 are moved away from each other, and a folded position (see FIG. 6), in which, the mounting ends 31" of the left and right frames 31 are moved toward each other.

Figure 6:
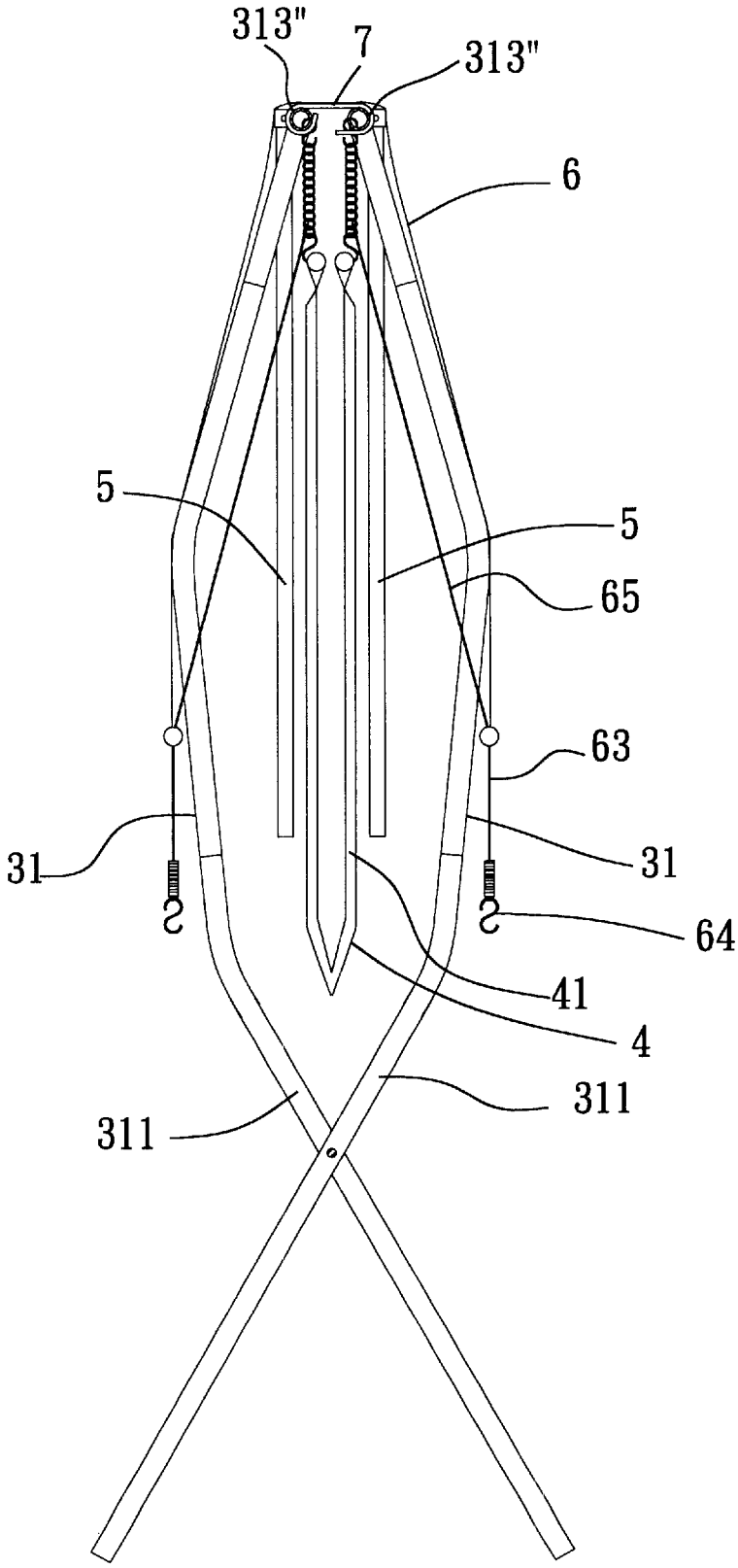
FIG. 6 illustrates the preferred embodiment in a folded state.

The bedding sheet 41 is disposed above the left and right frames 31, and has two opposite ends 412 respectively connected to the mounting ends 31" of the left and right frames 31 via two pairs of chains 42 such that the bedding sheet 41 will be stretched when the left and right frames 31 are disposed at the unfolded position, as best shown in FIGS. 4 and 5, and that the bedding sheet 41 will be folded when the left and right frames 31 are disposed at the folded position, as best shown in FIG. 6. Each of the chains 42 includes an annular ring 421 sleeved securely on one of the opposite ends 412 of the bedding sheet 41, and a hook 422 detachably hooked to the mounting end 31" of a respective one of the left and right frames 31.

In this embodiment, each of the left and right frames 31 includes a pair of parallel horizontal ground contact parts 311 that are adapted to be disposed on a ground surface, and a generally U-shaped supporting part 313. The supporting part 313 has two opposing arm portions 312 that are respectively angled away from the ground contact parts 311, and a mounting portion 313" that interconnects the arm portions 312 and that defines a respective one of the mounting ends 31" of the left and right frames 31. The pivot is in the form of an elongated rod 32 that is transverse to and that extends through the ground contact parts 311 of the left and right frames 31. Preferably, each of the arm portions 312 is formed by two rod sections 316, 317 which cooperatively define an obtuse angle therebetween. Each of the arm portions 312 is connected to the mounting portion 313" and the respective ground contact part 311 by plug-and-socket units 38, 39 so as to facilitate assembly and detachment thereof. Thus, transport and storage of the hammock assembly is convenient to conduct.

The preferred embodiment of the hammock assembly according to the present invention further includes a canopy unit 6 for providing shade to the bedding sheet 41. The canopy unit 6 includes left and right brackets 33 fixed to the mounting portions 313" of the supporting parts 313 of the left and right frames 31, left and right support rods 5 respectively extending into the left and right brackets 33, left and right pivots 51 respectively extending through the left and right brackets 33 and lower ends 52 of the support rods 5 so that each of the support rods 5 is turnable relative to a respective one of the mounting portions 313" between a position of use, in which the left and right support rods 5 stand upright relative to the mounting portions 313" and abut against the mounting portions 313" so as to be prevented from moving toward each other when the left and right frame members 31 are disposed at the unfolded position, and a position of non-use, in which the left and right support rods 5 extend downwardly from the mounting portions 313" (see FIG. 6) when the left and right frame members 31 are disposed at the folded position. The canopy unit 6 further includes a canopy 61 that is disposed above the bedding sheet 41, and that has two opposite ends 62 respectively and detachably connected to upper ends 53 of the left and right support rods 5 via two sets of hooks 64 and strings 63 so as to shade the bedding sheet 41 from the sun when the left and right frame members 31 are disposed at the unfolded position. Preferably, two pairs of ropes 65 interconnect the opposite ends 62 of the canopy 61 and the opposite ends 412 of the bedding sheet 41 so as to further stabilize the canopy 61 relative to the bedding sheet 41.

A generally C-shaped fastener hook 7 is used for hooking the mounting portions 313" of the supporting parts 313 of the left and right frames 31 when the left and right frame members 31 are disposed at the folded position.

With this invention thus explained, it is apparent that numerous modifications and variations can be made without departing from the scope and spirit of this invention. It is therefore intended that this invention be limited only as indicated in the appended claims.

I claim:

1. A hammock assembly comprising:

a left frame having a mounting end;

a right frame having a mounting end and opposite to and pivoted to said left frame about a pivot such that said left and right frames are rotatable relative to each other between an unfolded position, in which, said mounting ends of said left and right frames are moved away from each other, and a folded position, in which, said mounting ends of said left and right frames are moved toward each other; and a bedding sheet disposed above said left and right frames, and having two opposing ends respectively connected to said mounting ends of said left and right frames such that said bedding sheet will be stretched when said left and right frames are disposed at said unfolded position and that said bedding sheet will be folded when said left and right frames are disposed at said folded position, wherein each of said left and right frames includes a pair of parallel horizontal ground contact parts adapted to be disposed on a ground surface, and a generally U-shaped supporting part having two opposing arm portions that are respectively angled away from said ground contact parts, and a mounting portion interconnecting said arm portions and defining a respective one of said mounting ends of said left and right frames, said pivot being in the form of an elongated rod that is transverse to and that extends through said ground contact parts of said left and right frames.

2. The hammock assembly as defined in claim 1, further comprising a canopy unit including left and right brackets fixed to said mounting portions of said supporting parts of said left and right frames, and left and right support rods respectively pivoted to said left and right brackets and turnable relative to said mounting portions between a position of use, in which said left and right support rods stand upright relative to said mounting portions and abut against said mounting portions so as to be prevented from moving toward each other when said left and right frame members are disposed at said unfolded position, and a position of non-use, in which said left and right support rods extend downwardly from said mounting portions when said left and right frame members are disposed at said folded position, said canopy unit further including a canopy that is disposed above said bedding sheet, and that has two opposite ends respectively and detachably connected to said left and night support rods.

3. The hammock assembly as defined in claim 2, further comprising a generally C-shaped fastener book for hooking together said mounting portions of said supporting parts of said left and right faces when said left and right frame members are disposed at said folded position.

* * * * *